US007248805B2

(12) United States Patent
Hirota et al.

(10) Patent No.: US 7,248,805 B2
(45) Date of Patent: Jul. 24, 2007

(54) IMAGE FORMING APPARATUS AND DEVELOPING UNIT

(75) Inventors: Soh Hirota, Aichi-ken (JP); Masaki Tanaka, Toyohashi (JP); Masahiro Kouzaki, Toyohashi (JP); Kazuomi Sakatani, Toyokawa (JP); Mitsuru Obara, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 155 days.

(21) Appl. No.: 10/976,774

(22) Filed: Nov. 1, 2004

(65) Prior Publication Data

US 2006/0029404 A1 Feb. 9, 2006

(30) Foreign Application Priority Data

Aug. 5, 2004 (JP) ..... 2004-229100
Aug. 5, 2004 (JP) ..... 2004-229101
Aug. 5, 2004 (JP) ..... 2004-229102

(51) Int. Cl.
*G03G 15/08* (2006.01)

(52) U.S. Cl. ..... 399/27; 399/258

(58) Field of Classification Search ..... 399/27, 399/28, 29, 30, 53, 61, 63, 64, 223, 224, 399/258, 259

See application file for complete search history.

(56) References Cited

U.S. PATENT DOCUMENTS 4,485,760 A * 12/1984 Tanaka et al. ..... 399/259
4,951,091 A * 8/1990 Nawata ..... 399/27
5,526,100 A * 6/1996 Misago et al. ..... 399/29
5,604,576 A * 2/1997 Inoue et al. ..... 399/259 X
5,717,973 A 2/1998 Endoh et al.
5,930,567 A * 7/1999 Agano ..... 399/223
6,163,672 A * 12/2000 Parker et al. ..... 399/223
6,347,199 B1 * 2/2002 Morihara ..... 399/27

FOREIGN PATENT DOCUMENTS

JP 58-168058 A 10/1983
JP 6-051631 A 2/1994

(Continued)

OTHER PUBLICATIONS

Japanese Notification of Reasons for Refusal mailed on Sep. 19, 2006.

(Continued)

*Primary Examiner*—Sandra L. Brase
(74) *Attorney, Agent, or Firm*—Morrison & Foerster LLP

(57) ABSTRACT

An electrophotographic image forming apparatus includes a developing device including a developer reservoir for accommodating a mixed developer. The mixed developer includes a plurality of types of toner having a generally identical hue and different reflection densities. The apparatus also includes a replenishment device having a plurality of toner containers each accommodating one of the plurality of types of toner for replenishing the plurality of types of toner to the developer reservoir; a first detector for detecting whether each of the toner containers is completely empty of toner; and a second detector for detecting whether the developer reservoir is nearly or completely empty of mixed developer. A controller controls the replenishment device and allows or prohibits a printing operation based on the detection result of the first and the second detectors.

11 Claims, 12 Drawing Sheets

FOREIGN PATENT DOCUMENTS

| | | | |
|---|---|---|---|
| JP | 7-028271 | A | 1/1995 |
| JP | 8-202137 | A | 8/1996 |
| JP | 8-248727 | A | 9/1996 |
| JP | 11-212327 | A | 8/1999 |
| JP | 2000-98712 | | 4/2000 |
| JP | 2000-293009 | | 10/2000 |
| JP | 2001-249546 | A | 9/2001 |

OTHER PUBLICATIONS

Japanese Notification of Reasons for Refusal mailed on Oct. 31, 2006.

* cited by examiner

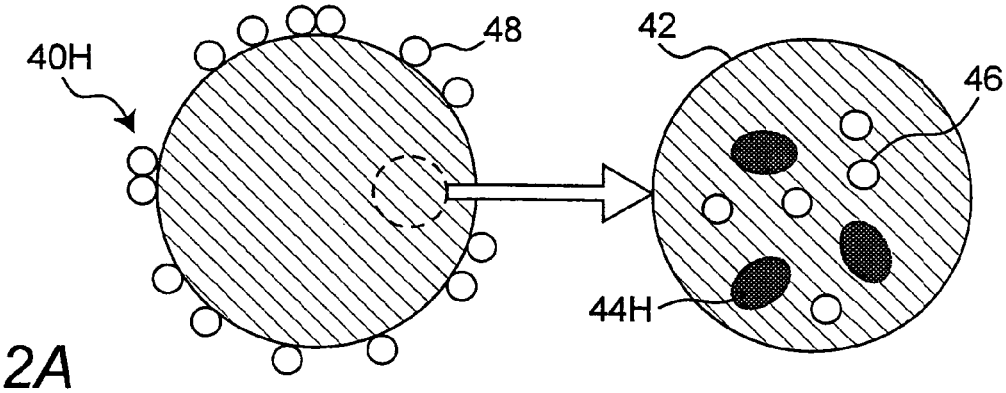
Fig. 2A
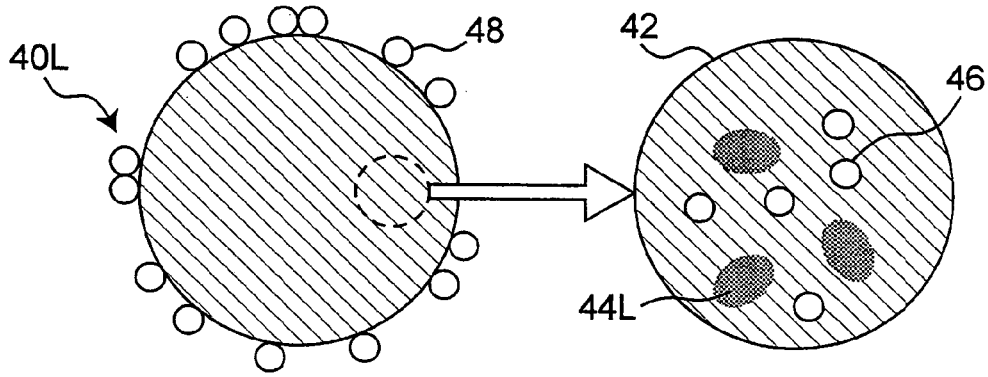
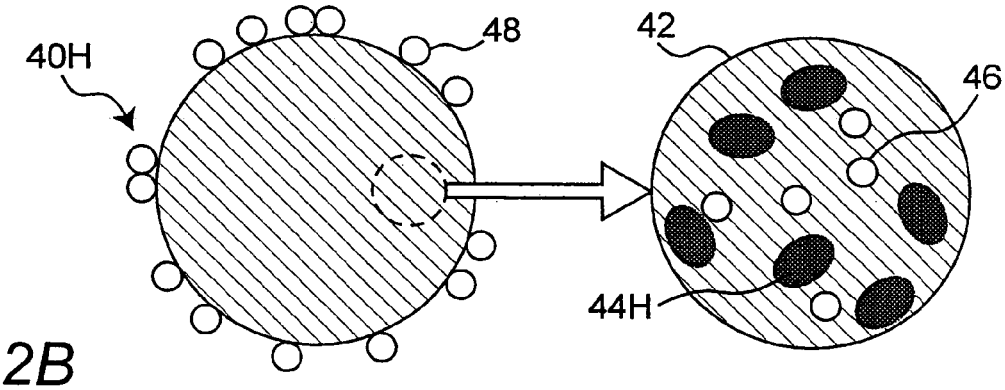
Fig. 2B
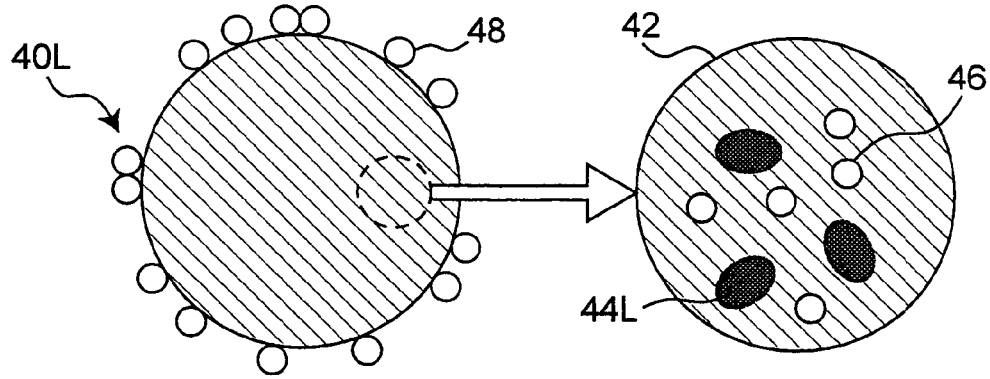

IMAGE FORMING APPARATUS AND DEVELOPING UNIT

RELATED APPLICATION

This application is based on Japanese Patent Applications Nos. 2004-229100, 2004-229101 and 2004-229102, each content of which being incorporated herein by reference.

BACKGROUND OF THE INVENTION

1. Field of the Invention

The present invention generally relates to an electrophotographic image forming apparatus such as copying machine, printer, facsimile or multifunction peripheral having functions of printing, copying, faxing and the like. More particularly, the present invention relates to an image forming apparatus that utilizes a mixed developer containing a plurality of types of toner having a generally identical hue and different reflection densities. The present invention also relates to a developing unit used in such an image forming apparatus.

2. Description of the Related Art

There has been known an image forming device which enables image quality of images with highlight areas to be improved and the consumption of a developer to be suppressed.

Japanese Patent Publication No. 2000-98712 discloses an image forming device that utilizes a mixed developer including two types of toner having an identical hue and different reflection densities.

The amount of electrostatic charge on the toner with a low reflection density is set to be smaller than that of the toner with a high reflection density. Thus, the toner with a low reflection density is supplied more easily from a developing roller onto a photoreceptor drum than the toner with a high reflection density. Accordingly, in case where latent image areas with a "low density" (where the amount of exposure is small and therefore their decay level of electric potential is low) on the photoreceptor drum are developed, the toner with a low reflection density is mainly used. This suppresses density fluctuations, which would be generated in case where only a toner with a high reflection density is used, and allows a fine image without graininess to be formed.

On the other hand, the amount of the toner with a high reflection density in the developing device is set to be larger than that of the toner with a low reflection density. Accordingly, in case where latent image areas having a "high density" (where the amount of exposure is large and therefore their decay level of electric potential is high) on the photoreceptor drum are developed, the toner with a high reflection density is mainly used. This suppresses the consumption of the developer, which would be larger in case where only a toner with a low reflection density is used for developing latent image areas having a high density on the photoreceptor drum.

Japanese Patent Publication No. 2000-293009 describes an image forming device in which a test patch image is formed on a photoreceptor drum and the reflection density of the test patch image is detected. A toner with a low reflection density is supplied from a toner hopper when the detected reflection density of the test patch image is increased.

In the image forming device described, for example, in JP No. 2000-98712, a mixture ratio of the two types of toner of the developer needs to be controlled so that it falls within a predetermined range in order to ensure stable image quality after a number of documents have been printed.

Also, where the developing device is empty of mixed developer, toner needs to be replenished from a replenishment device to the developing device. Accordingly, a printing operation is prohibited for a certain period of time. Such dead time needs to be minimized to the benefit of the user.

SUMMARY OF THE INVENTION

An object of the present invention is to provide an image forming apparatus suitable for controlling a mixture ratio of two or more types of toners having a generally identical hue and different reflection densities.

Another object of the present invention is to provide an image forming apparatus which enables a dead time to be reduced.

To achieve these objects, a first aspect of the present invention is an electrophotographic image forming apparatus that includes a developing device incorporating a developer reservoir for accommodating a mixed developer. The mixed reservoir includes a plurality of types of toner having a generally identical hue and different reflection densities. The apparatus also includes a replenishment device including a plurality of toner containers each accommodating one of the plurality of types of toner for replenishing the plurality of types of toner to the developer reservoir; a first detector for detecting whether each of the toner containers is completely empty of toner; and a second detector for detecting whether the developer reservoir is nearly or completely empty of mixed developer. A controller controls the replenishment device and allows or prohibits a printing operation based on the detection result of the first and the second detectors.

Herein, "each of the toner containers is completely empty of toner" means that there is no sufficient amount of the toner remaining in the toner container to replenish to the developer reservoir.

Also, "the developer reservoir is nearly empty of mixed developer" means that although there is a smaller amount of the mixed developer remaining in the developer reservoir than a predetermined value, the amount of the mixed developer is sufficient enough to ensure image quality of an image which is visualized by supplying the mixed developer from the developing device to a latent image on an image bearing member. Further, "the developer reservoir is completely empty of mixed developer" means that there is no sufficient amount of the mixed developer remaining in the developer reservoir to supply to an image bearing member.

With the apparatus according to the first aspect, even where the developer reservoir is nearly or completely empty and one of the toner containers is completely empty, toner is replenished from the other toner container if it is not completely empty and a printing operation is allowed. Therefore, even if one of the toner containers is completely empty, it needs not always be exchanged with a new one. This allows a dead time to be minimized.

In a preferable embodiment, a determination as to whether a printing operation is allowed or prohibited is made based on a print mode (for example, character mode or photograph mode) as well as the detection result of the first and second detectors.

A second aspect of the present invention is an electrophotographic image forming apparatus that includes a developing device incorporating a developer reservoir for accommodating a mixed developer. The mixed developer includes two types of toner having a generally identical hue and different reflection densities. The apparatus also includes a replenishment device for replenishing the two types of toner to the developer reservoir; a unit for determining a mixture ratio of the two types of toner in the developer reservoir; and a detector for detecting whether the developer reservoir is nearly empty of mixed developer. A controller controls the replenishment device based on the mixture ratio determined by the unit and the detection result acquired by the detector so that the mixture ratio falls within a predetermined range.

With the apparatus according to the second aspect, replenishment of toners is controlled so that a mixture ratio of the two types of toner of the mixed developer in the developer reservoir falls within a predetermined range. This allows stable and high image quality after a number of documents have been printed.

A third aspect of the present invention is an electrophotographic image forming apparatus that includes a developing device incorporating a developer reservoir for accommodating a mixed developer. The mixed developer includes a plurality of types of toner having a generally identical hue and different reflection densities. The apparatus also includes a replenishment device for replenishing the plurality of types of toner to the developer reservoir. The replenishment device includes a first toner container for accommodating at least one type of toner out of the plurality of types of toner and a second toner container for accommodating at least one another type of toner out of the plurality of types of toner.

With the apparatus according to the third aspect, since each toner container accommodates one or more types of toner, replenishment of controlled amounts of one or more types of toner from each one of the toner containers allows a mixture ratio of the types of toner in the developer reservoir to be maintained within a predetermined range.

BRIEF DESCRIPTION OF THE DRAWINGS

The above-mentioned and other objects, advantages and features of the invention will become apparent from the following description thereof taken in conjunction with the accompanying drawings in which:

FIG. 2A is a view showing an example of two types of cyan toner with high and low reflection densities, the two types of cyan toner having coloring agents with different reflection densities;

FIG. 2B is a view showing another example of two types of cyan toner with high and low reflection densities, the two types of cyan toner having different amounts of a coloring agent;

DETAILED DESCRIPTION OF THE PREFERRED EMBODIMENTS

With reference to the drawings, preferred embodiments of the present invention will be described hereinafter.

First Embodiment

Figure 1:
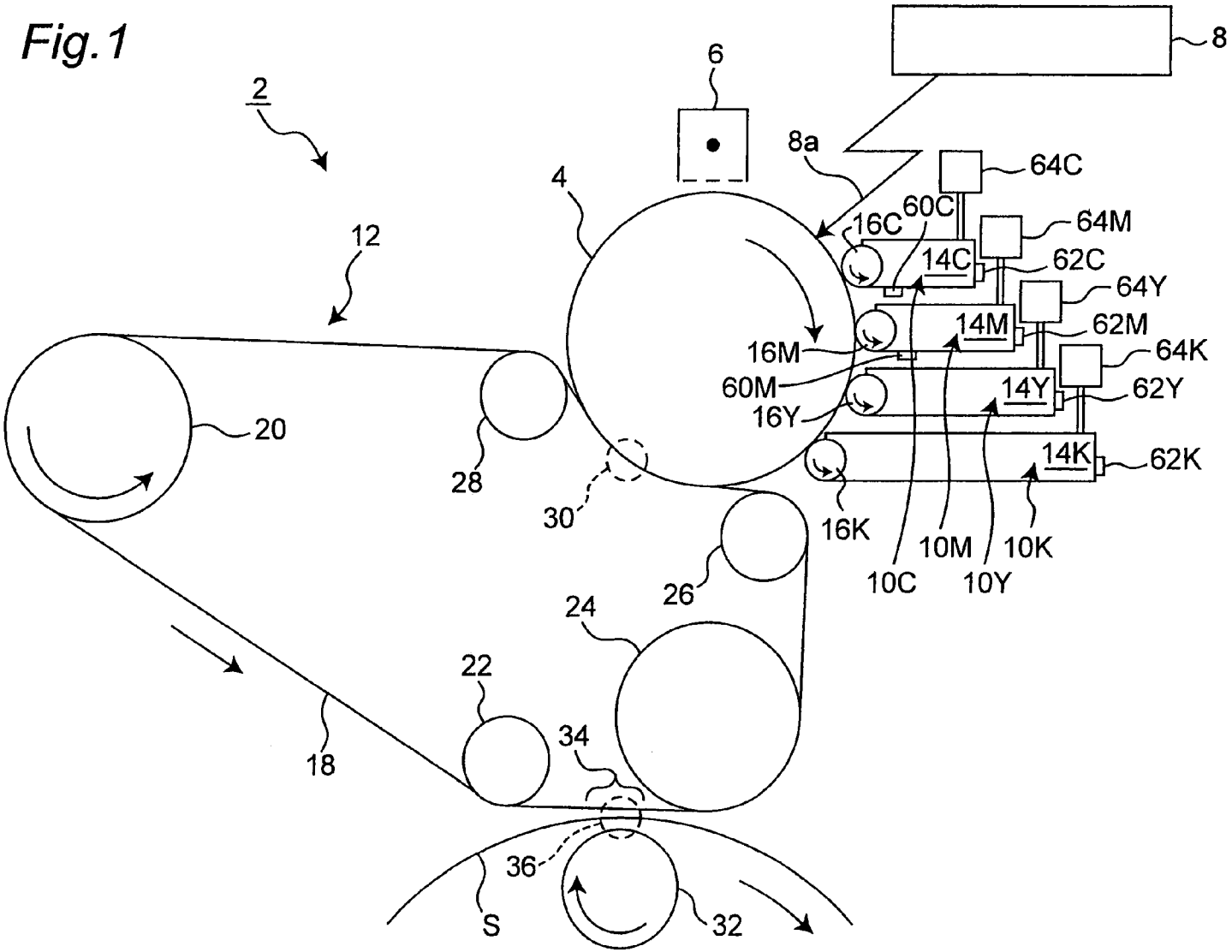
FIG. 1 is a schematic view of a first embodiment of the image forming device according to the present invention.

Referring to FIG. 1, there is shown a color printer, which is a first embodiment according to the present invention. The printer, generally indicated at reference number 2, includes a photoreceptor drum 4 as image bearing member for rotation in a clockwise direction of the drawing. Around the photoreceptor drum 4, a charging device 6, an exposing device 8, four developing devices 10C, 10M, 10Y and 10K and a primary transfer device 12 are positioned in this order along the rotational direction of the drum.

The charging device 6 is used for charging uniformly the surface of the photoreceptor drum 4 (the surface electric potential is $V_0$). The exposing device 8 is used for emitting laser beam 8*a* selectively onto the photoreceptor drum 4 in response to image data to form a latent image on the drum.

Each of the developing devices 10C–10K is used for providing the photoreceptor drum 4 with corresponding toner to visualize the latent image. More specifically, the developing devices 10C, 10M, 10Y and 10K include developer reservoirs 14C, 14M, 14Y and 14K for accommodating cyan(C), magenta(M), yellow(Y) and black(K) developers and developing rollers 16C, 16M, 16Y and 16K each operatively connected with its respective motor not shown so that it can be rotated in the counterclockwise direction of the drawing, respectively. The rotation of each of the developing rollers 16C–16K causes the corresponding developer deposited on the surface of the developing roller to be transported to an opposing region between the developing roller and the photoreceptor drum 4, where the developer is supplied to the latent image portion of the drum. Each of the developing rollers 16C–16K is applied with a bias voltage $V_B$.

The cyan developer in the developer reservoir 14C is a "single-component" (in a sense that it contains no carrier) mixed developer including two types of cyan toner having a generally identical hue and different high reflection densities. Hereinafter, the toner with a low reflection density and the toner with a high reflection density are referred to as "LRD toner" and "HRD toner", respectively. Likewise, the magenta developer in the developer reservoir 14M is a single-component mixed developer including two types of magenta toner having a generally identical hue and different (low and high) reflection densities. The yellow developer in the developer reservoir 14Y includes a single type of yellow toner. Likewise, the black developer in the developer reservoir 14K includes a single type of black toner. The mixed developers, i.e. the cyan and the magenta developers will be described in more detail below.

The primary transfer device 12 includes an intermediate transfer belt 18. The intermediate transfer belt 18 is made of resin sheet such as polycarbonate in which carbon black is dispersed so that the belt has a surface electrical resistance of about $10^5$–$10^{12}$ Ω/cm$^2$. The intermediate transfer belt 18 is supported by the circumferences of five rollers 20, 22, 24, 26 and 28. The roller 22 is a tension roller that provides tension to the intermediate transfer belt 18. The roller 20 is operatively connected with a drive motor not shown. The rotation of the roller 20 causes the rollers 22, 24, 26 and 28 to rotate so that the intermediate transfer belt 18 is rotated in the counterclockwise direction of the drawing. The portion of the intermediate transfer belt 18 between the rollers 26 and 28 is in contact with the circumference of the photoreceptor drum 4 to define a primary transfer region 30 where a toner image (cyan, magenta, yellow or black toner image) on the drum is transferred onto the belt.

A secondary transfer roller 32 is mounted for rotation in the clockwise direction of the drawing and is opposed to a portion 34 of the intermediate transfer belt 18 at an immediate upstream side of the roller 24 with regard to the rotational direction of the belt. The secondary transfer roller 32 is made of foam rubber such as silicone or urethane in which carbon black is dispersed so that the roller has a surface electrical resistance of about $10^5$–$10^{12}$ Ω/cm$^2$. The belt portion 34 and the secondary transfer roller 32 define a secondary transfer region 36 where a sheet (recording medium) S passes along a direction indicated by an arrow and superimposed toner images, which will be describe below, on the intermediate transfer belt 18 is transferred onto the sheet.

With the printer 2 so constructed, a controller (described below) controls the charging device 6, so that the surface of the photoreceptor drum 4 is uniformly charged. The controller generates a control signal in response to color image data stored in an image memory not shown and then outputs it to the exposing device 8. The exposing device 8 selectively emits laser beam 8*a* onto the photoreceptor drum 4. As a result, the electric potential of surface portions where the laser beam 8*a* is emitted is decayed, so that a latent image for cyan is formed on the photoreceptor drum 4. The latent image for cyan on the photoreceptor drum 4 is visualized by supplying a mixed cyan developer to the latent image by means of the developing device 10C to form a cyan toner image. The cyan toner image is transported by the rotation of the photoreceptor drum 4 to the primary transfer region 30 and transferred onto the intermediate transfer belt 18.

Next, a magenta toner image of a mixed magenta developer, which has been formed on the photoreceptor drum 4 in a similar manner, is transferred onto the intermediate transfer belt 18 so that it is superimposed on the cyan toner image. Then, a yellow toner image of a non-mixed yellow developer, which has been formed on the photoreceptor drum 4 in a similar manner, is transferred onto the intermediate transfer belt 18 so that it is superimposed on the cyan and magenta toner images. Thereafter, a black toner image of a non-mixed black developer, which has been formed on the photoreceptor drum 4 in a similar manner, is transferred onto the intermediate transfer belt 18 so that it is superimposed on the cyan, magenta and yellow toner images.

The superimposed toner images are transported by the movement of the intermediate transfer belt 18 to the secondary transfer region 36. On the other hand, a sheet S is fed from a sheet supply cassette not shown to the secondary transfer region 36. Thus, the superimposed toner images are transferred by means of the secondary transfer roller 32 onto the sheet S moving past the secondary transfer region 36.

The sheet S onto which the color toner image has been formed is supplied to a fixing device not shown, where the color toner image is fixed on the sheet S.

Next, a latent image formed on the photoreceptor drum 4 and a mixed developer will be described in detail.

The printer 2 employs a pulse width modulation technique of the laser beam 8*a* to represent gray levels. Therefore, the latent image includes areas with a "low density" where an electric potential decay level is low and areas with a "high density" where an electric potential decay level is high. Hereinafter, a latent image area with a low density and a latent image area with a high density are referred to as "LD area" and "HD area", respectively. When the laser-emitting period is relatively short, the decay of the electric potential of the photoreceptor drum surface is small (i.e., the electric potential does not reach a saturation point), thereby forming an LD area. On the other hand, when the laser-emitting period is sufficiently long, the decay of the electric potential of the photoreceptor drum surface is large (i.e., the electric potential reaches a saturation point), thereby forming an HD area. In the specification, the LD area designates an area where a developer is supplied to create a highlight area. The HD area designates an area where a developer is supplied to create a shadow area.

As described above, the cyan developer is a mixed developer including two types of toner having a generally identical hue and different reflection densities. The mixture ratio of the developer in the reservoir 14C is adjusted to be equal or more than a predetermined value or lower limit $R_L$. In the embodiment, the mixture ratio is defined as a weight ratio of the LRD toner to the HRD toner. According to the definition, $R_L$ is more than zero and is less than one. In other words, the amount of the HRD cyan toner is larger than that of the LRD cyan toner in the reservoir 14C.

Note that other definition may be used instead. For example, where the mixture ratio is defined as a weight ratio of the HRD toner to the LRD toner, an upper limit thereof needs to be taken into consideration instead of a lower limit.

FIGS. 2A and 2B show examples of the LRD and the HRD cyan toners. In an example of FIG. 2A, the HRD toner 40H is made of resin 42 in which a coloring agent 44H and a charge control agent 46 are dispersed. An external additive 48 may be added. The LRD toner 40L is generally identical to the HRD toner 40H except that the coloring agent 44L has a lower reflection density than the coloring agent 44H. In an example of FIG. 2B, the coloring agent 44H and 44L have an identical reflection density. The weight ratio of the coloring agent 44H to the resin 42 is higher than the weight ratio of the coloring agent 44L to the resin 42. In the latter, the suitable range of the mixture ratio is set to be equal to or more than 0.45 while the weight ratios are 4 and 10 percents with regard to the LRD cyan toner and the HRD cyan toner, respectively, for instance.

In order that an adhesive force of the LRD cyan toner with regard to the developing roller 16C of the developing device 10C is smaller than that of the HRD cyan toner to allow the LRD cyan toner to more easily be deposited onto the photoreceptor drum 4, an amount of electrostatic charge on the LRD cyan toner is smaller than that on the HRD cyan toner. For this purpose, a mean particle size of the LRD cyan toner may be different from that of the HRD cyan toner or different amounts of after-treatment agent such as charge control agent may be added to the LRD and the HRD cyan toners.

Instead, the LRD cyan toner may have a higher sphericity than the HRD cyan toner in order that an adhesive force of the LRD with regard to the developing roller 16C is smaller than that of the HRD cyan toner.

Figure 3:
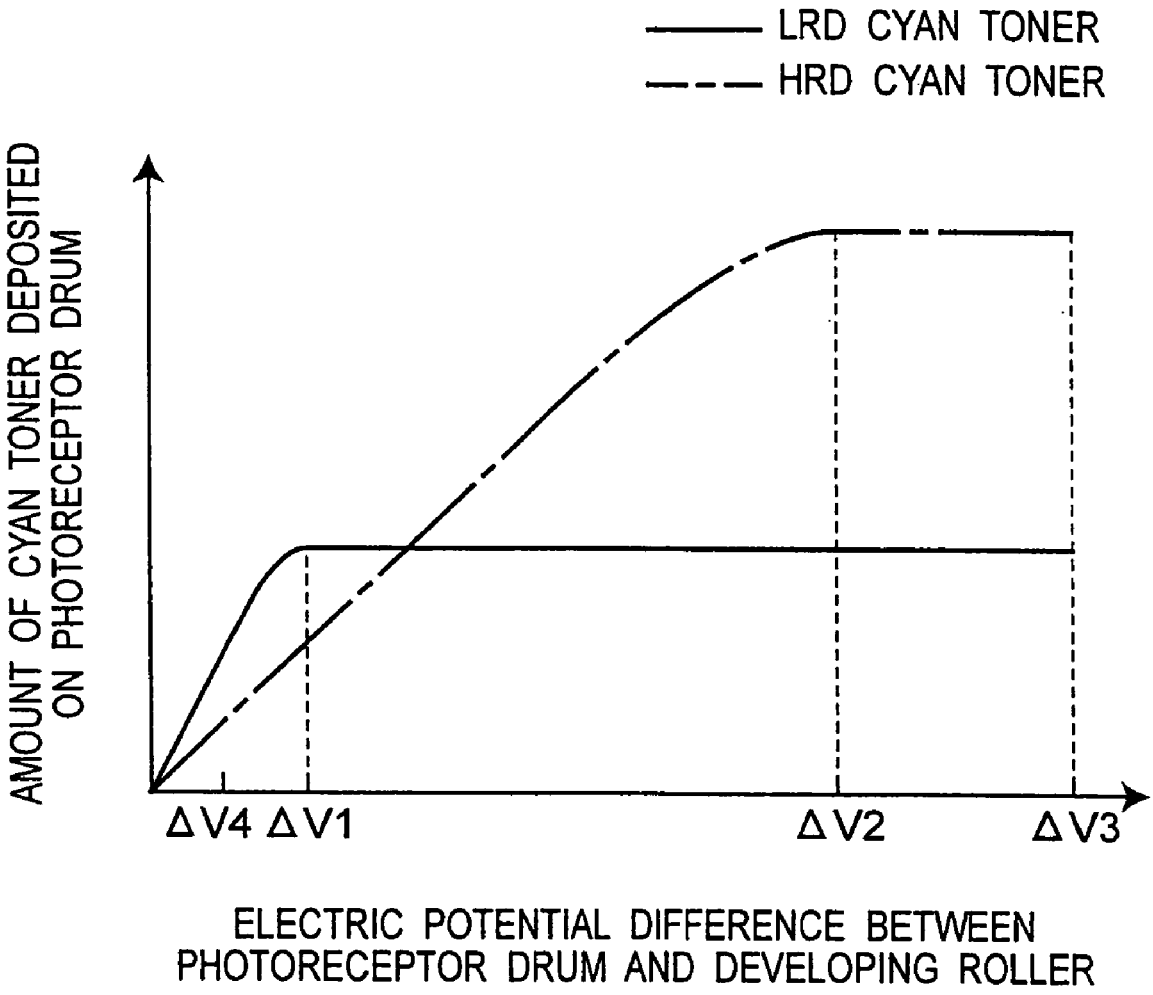
FIG. 3 is a graph showing an amount of the cyan toner with a high reflection density or the cyan of toner with a low reflection density supplied onto the photoreceptor drum as a function of an electric potential difference between the drum and the developing roller.
Figure 4:
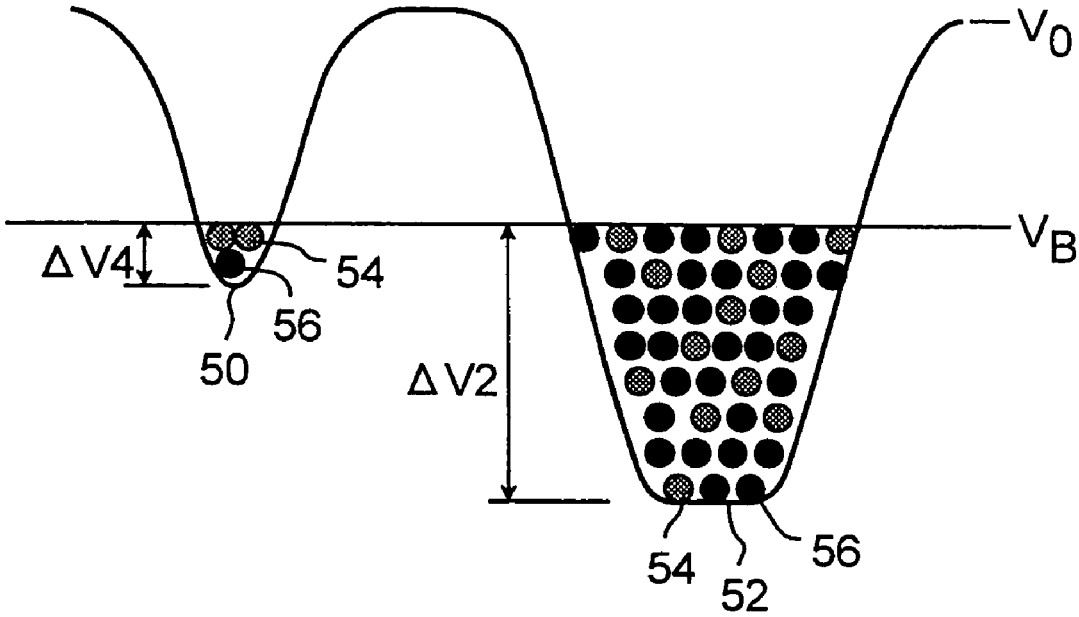
FIG. 4 is a view showing a relationship of an electric potential difference between the photoreceptor drum and the developing roller and a ratio of amounts of two types of cyan toners with high and low reflection densities supplied to the drum.

Referring now to FIGS. 3 and 4, a characteristic of the mixed cyan developer including the HRD and the LRD cyan toners will be described. FIG. 3 shows an amount of the HRD or the LRD cyan toner deposited on the photoreceptor drum as a function of an electric potential difference between the developing roller applied with a bias voltage $V_B$ and a latent image area on the drum.

As shown in FIG. 3, where an electric potential difference between the developing roller and a latent image area of the photoreceptor drum is relatively low, the LRD cyan toner is mainly supplied to the area, since the LRD cyan toner is less adhesive than the HRD cyan toner to the developing roller. Where the electric potential difference between the developing roller and a latent image area of the photoreceptor drum is lower than a value ΔV1, the higher the electric potential difference is, the larger the amount of the LRD cyan toner supplied to the latent image area of the photoreceptor drum is. Where the electric potential difference is higher than ΔV1, the amount of the LRD cyan toner supplied to the photoreceptor drum is substantially constant, i.e., the amount reaches a saturation point. This means that most of the LRD cyan toner in the mixed cyan developer opposed to the latent image area is supplied to the area where the electric potential difference is high to some degree.

On the other hand, where an electric potential difference between the developing roller and a latent image area of the photoreceptor drum is relatively low, the amount of the HRD cyan toner supplied to the area is small. However, the higher the electric potential difference between the developing roller and a latent image area of the photoreceptor drum is, the larger the amount of the HRD cyan toner supplied to the latent image area of the drum is, as long as the electric potential difference is lower than a value ΔV2. Where the electric potential difference is higher than ΔV2, the amount of the HRD cyan toner supplied to the photoreceptor drum is substantially constant, i.e., the amount reaches a saturation point. This means that most of the HRD cyan toner in the mixed cyan developer (and therefore most of the mixed cyan developer) opposed to the latent image area is supplied to the area when the electric potential difference is sufficiently high. A weight ratio of the two types of cyan toner supplied onto the photoreceptor drum in case where the electric potential difference is more than ΔV2 is generally identical to a mixture ratio of the two types of cyan toner in the reservoir 14C. Note that, in FIG. 3, a value ΔV3 designates an electric potential difference which corresponds to the electric potential of the latent image area of the photoreceptor drum where the potential reaches a saturation point.

FIG. 4 shows a relationship of an electric potential difference between each of two latent image areas on the photoreceptor drum and the developing roller and a ratio of amounts of two types of cyan toner supplied to the each of the latent image areas. A latent image area 50 is an LD area (a highlight area is created) that corresponds to an electric potential difference ΔV4 in FIG. 3. A latent image area 52 is an HD area (where a shadow area is created) that corresponds to the electric potential difference ΔV2 in FIG. 3. As shown, a larger amount of the LRD cyan toner 54 is supplied to the LD area 50 than the amount of the HRD cyan toner 56. On the other hand, a larger amount of the HRD cyan toner 56 is supplied to the HD area 52 than the amount of the LRD cyan toner 54.

As is apparent from the above description, the LRD cyan toner is inevitably used for developing HD areas (corresponding to shadow areas). Therefore, where an HD area is developed, the HRD cyan toner used in the printer 2 according to the embodiment needs to have a larger reflection density than a single type of cyan toner used in a conventional image forming device, in order to obtain an identical image density to that in case of the conventional device under the condition that an amount of the cyan developer (including the LRD and the HRD toners) deposited on the photoreceptor drum is identical to that of the conventional single type of cyan toner. For example, where a weight ratio of the coloring agent to the resin in a conventional single type of cyan toner is 8%, the weight ratio in the case of the HRD cyan toner is set to be 10%.

As described, the LRD cyan toner 54 is mainly used for developing an LD area (corresponding to a highlight area). The same holds true for the magenta developer. Therefore, the printer 2 allows a fine image without graininess to be formed by developing an LD area mainly with the LRD toner.

With regard to the cyan and magenta developers, where images with relatively many highlight areas such as photographic image are successively printed using the printer 2, a large amount of the LRD toner is consumed. As a result, the amount of the LRD toner per volume in the developer is decreased. This causes an increased amount of the HRD toner to be supplied from the developing roller to LD areas, resulting in increased graininess of the image. As the amount of the LRD toner is decreased, the mixture ratio of the developer is decreased. Thus, the printer 2 is designed so that each mixture ratio of the cyan and the magenta developers is controlled to be equal to or more than an appropriate predetermined value $R_L$.

For this purpose, with regard to the cyan and magenta developers, a magnetic substance such as iron powder, ferrite or magnetic fine particles is added only to the HRD toner. That is, each of the cyan and magenta developers includes magnetic and non-magnetic toners. Accordingly, the consumption of the mixed developer causes a mixture ratio thereof to change, resulting in a change in a magnetic permeability (appearance magnetic permeability which varies according to a mixture ratio of the two types of toners) of the developer. A magnetic substance may be added only to the LRD toner, instead.

Figure 5:
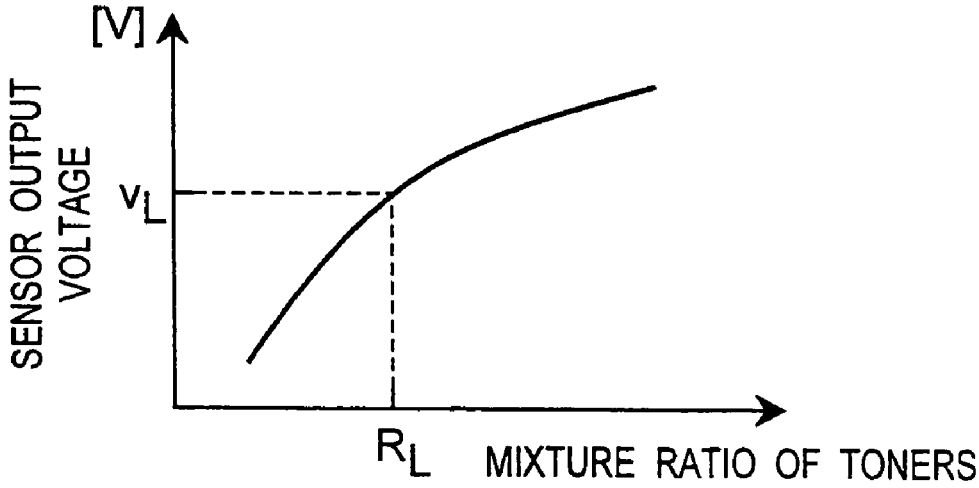
FIG. 5 is a graph showing a relationship between a mixture ratio of the two types of toner in the developer reservoir and a voltage outputted from the magnetic permeability detection sensor shown in FIG. 1.

Referring back to FIG. 1, the developing devices 10C an 10M include sensors 60C and 60M, located at bottom walls of the reservoirs 14C and 14M, for generating a signal used to determine mixture ratios of the cyan and the magenta developers therein, respectively. Each of the sensors 60C and 60M is an inductance detection type sensor that detects a magnetic permeability of the corresponding mixed developer per volume and emits an electrical signal or voltage signal indicative of the magnetic permeability. As shown in FIG. 5, the sensors 60C and 60M are designed so that they generate a higher detection voltage as the magnetic permeability is lower (the percentage of the non-magnetic LRD is higher). A voltage outputted from the sensor 60C or 60M that is equal to or more than $v_L$ corresponds to a mixture ratio equal to or more than the lower limit $R_L$.

The developing devices 10C, 10M, 10Y and 10K include empty sensors 62C, 62M, 62Y and 62K for detecting whether there is some amount of the developer, which ensures that image quality is sufficient, remaining in the reservoirs 14C, 14M, 14Y and 14K, respectively (in other words, whether the reservoir of the developing device is "nearly empty" of developer). The empty sensor may include light-emitting and light-detecting elements, for example. Where the developer prevents light emitted from the light-emitting element from entering the light-detecting element, the empty sensor does not output a signal, indicating that there is sufficient amount of developer remaining in the reservoir. Where light emitted from the light-emitting element enters the light-detecting element, the empty sensor outputs a signal, indicating that there is only a slight amount of developer remaining in the reservoir, which would result in insufficient image quality.

Figure 6:
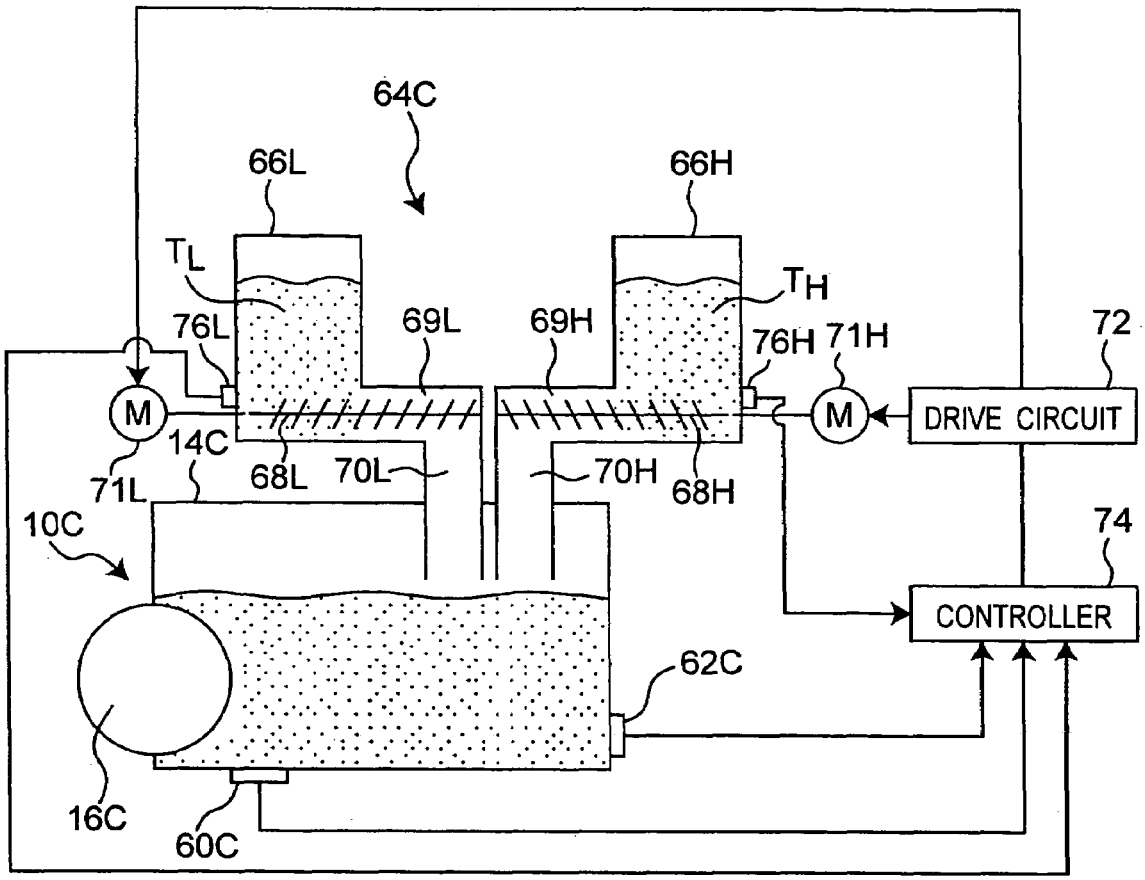
FIG. 6 is an enlarged schematic view of the developing device for cyan and the replenishment device for supplying a cyan developer to the developing device of the image forming device in FIG. 1.
Figure 7:
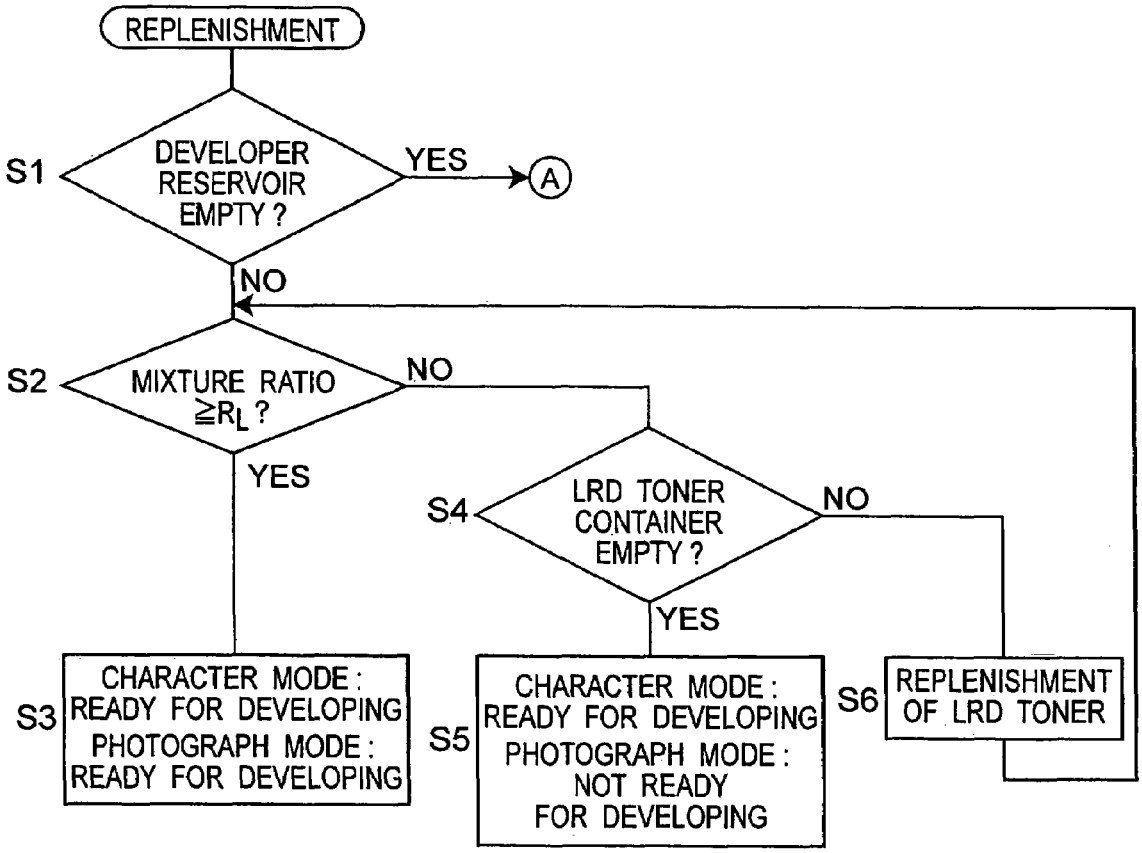
FIG. 7 is a first part of a flowchart illustrating a replenishment sequence of the cyan developer in the first embodiment.
Figure 8:
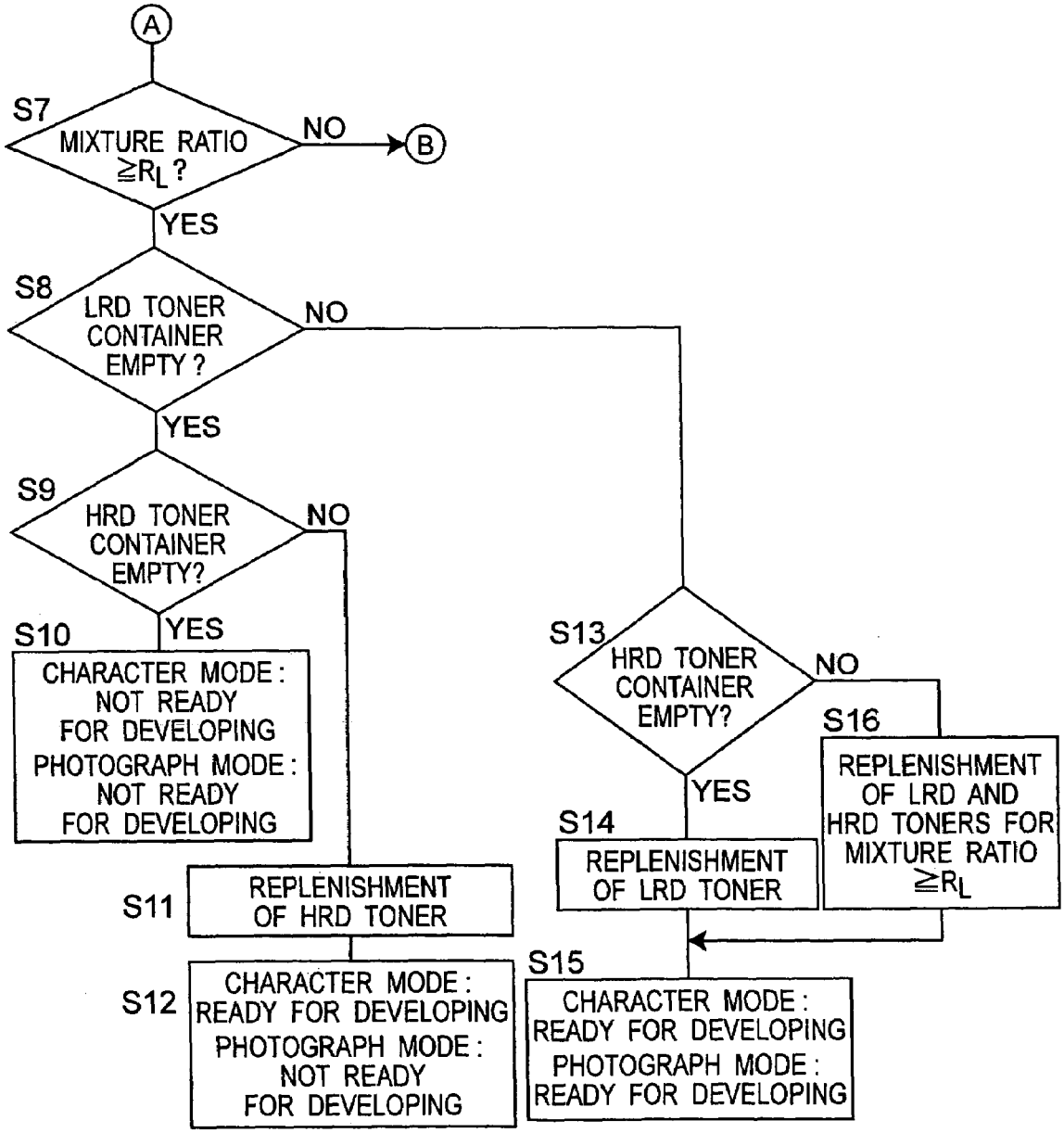
FIG. 8 is a second part of a flowchart illustrating a replenishment sequence of the cyan developer in the first embodiment.
Figure 9:
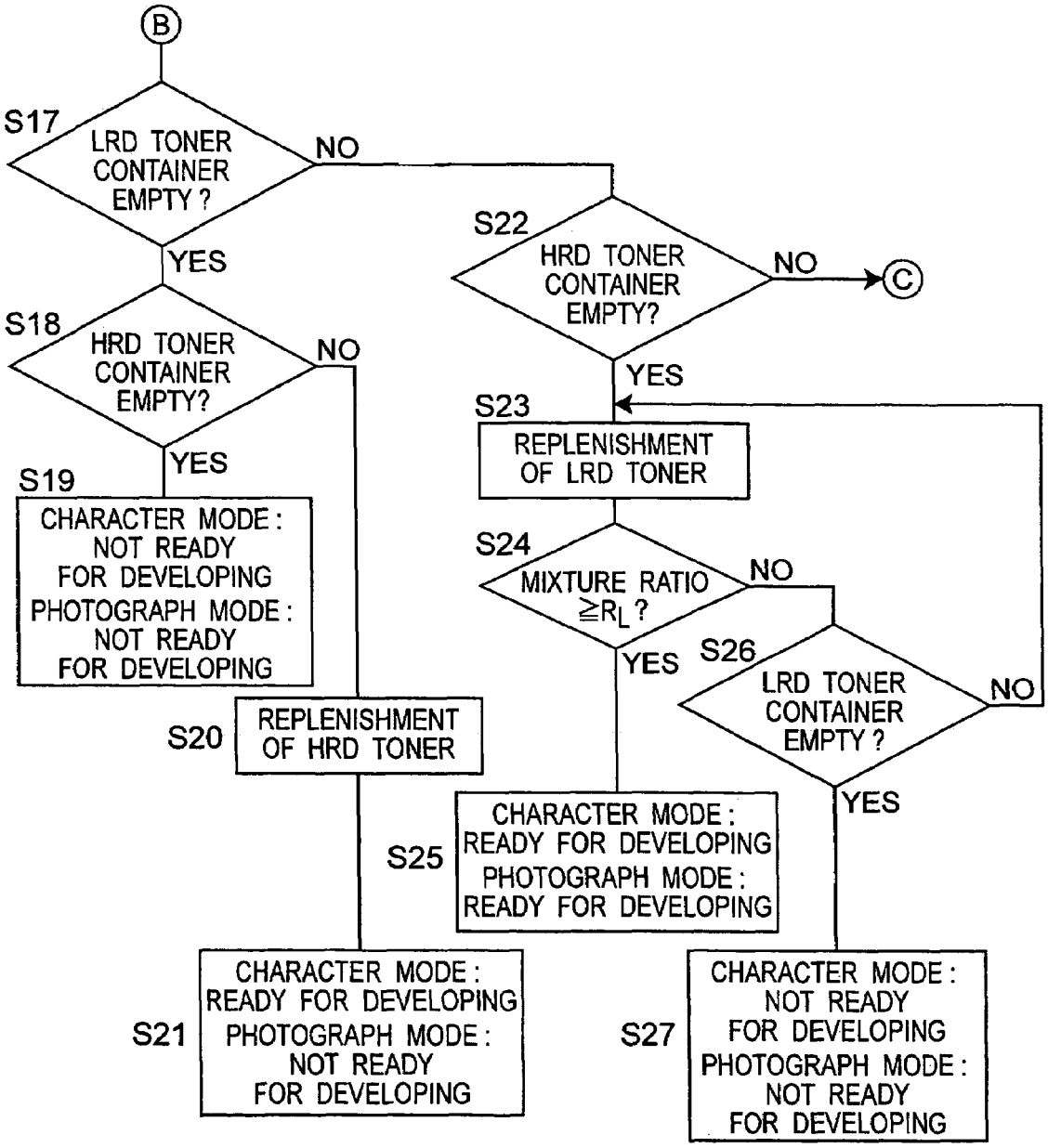
FIG. 9 is a third part of a flowchart illustrating a replenishment sequence of the cyan developer in the first embodiment.
Figure 10:
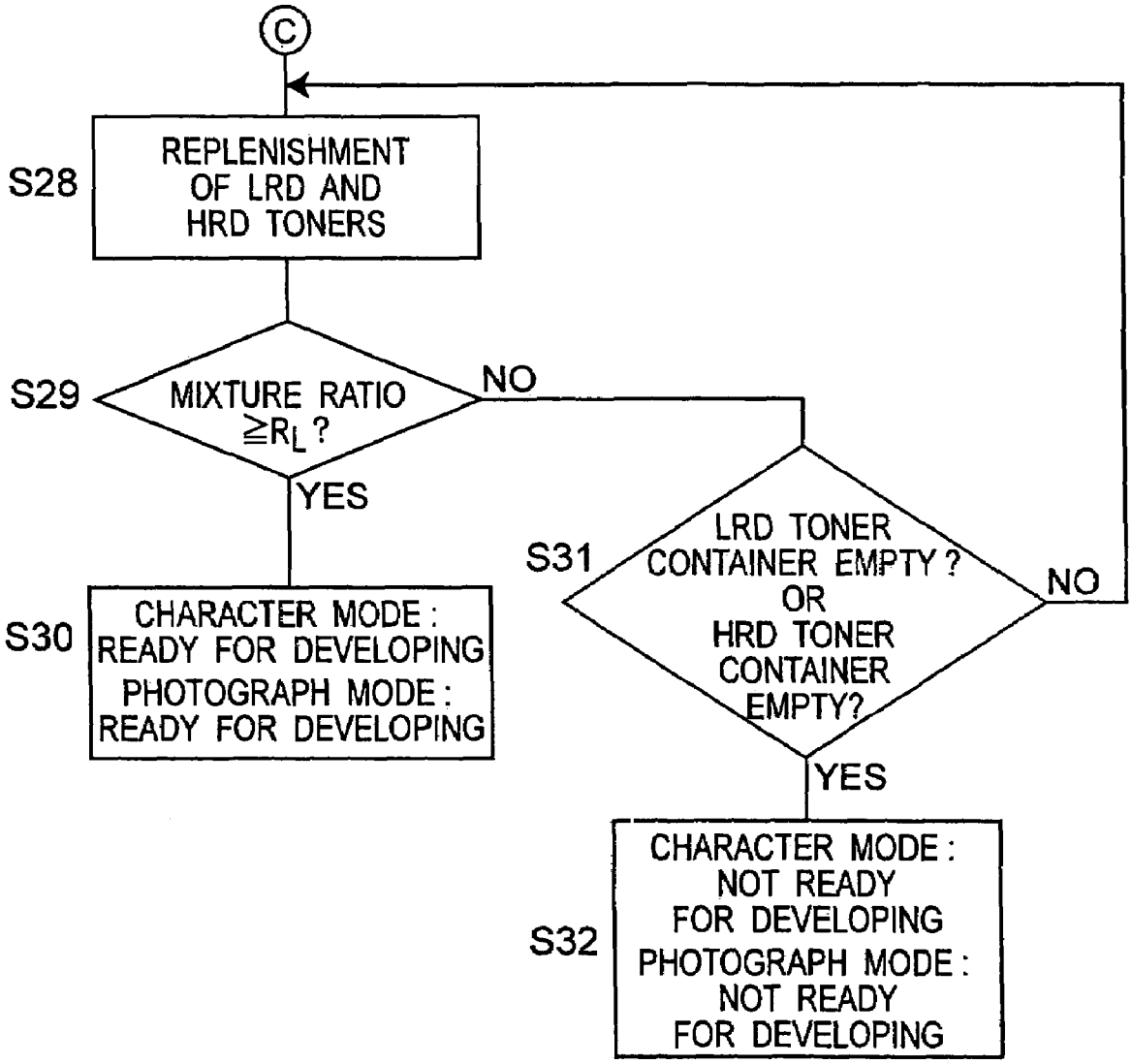
FIG. 10 is a fourth part of a flowchart illustrating a replenishment sequence of the cyan developer in the first embodiment.

Connected with the developing device 10C, 10M, 10Y and 10K are replenishment devices 64C, 64M, 64Y and 64K, respectively, for replenishing corresponding developers to the developing device. More specifically, as shown in FIG. 6, the replenishment device 64C includes two toner containers 66L and 66H for accommodating LRD cyan toner $T_L$ and HRD cyan toner $T_H$ and conveying screws 68L and 68H for conveying the LRD toner and the HRD toner through passages 69L and 69H to apertures 70L and 70H, where the LRD toner and the HRD toner fall into the reservoir 14C. The reservoir 14C includes an agitator not shown for agitating and mixing the LRD and the HRD toners. The screws 68L and 68H are operatively connected with motors 71L and 71H, respectively, which are in turn electrically connected with a drive circuit 72. The drive circuit 72 drives the motors 71L and 71H in response to a signal from a controller 74 for controlling a printing operation of the printer 2.

The replenishment device 64C also includes empty sensors 76L and 76H for detecting whether the LRD and the HRD toners exist virtually in the toner containers 66L and 66, respectively. In other words, the empty sensor 76L and 76H detect whether the toner containers 66L and 66H are "completely empty" of toner. As defined above, the "completely empty" means that there is no sufficient toner remaining in the toner container to replenish to the reservoir 14C.

The replenishment device 64M is identical to the replenishment device 64C except that LRD magenta toner and HRD magenta toner are accommodated in the two containers, respectively.

The replenishment devices 64Y and 64K are a conventional one that includes one container in which a single type of toner is accommodated and an empty sensor for detecting whether the toner exists virtually in the toner container. Therefore, they are not described further.

The sensors 60C, 62C, 76L and 76H are designed to output detection signals to the controller 74. Although not illustrated, detection signals from other sensors such as the sensors 60M, 62M, 62Y and 62K or empty sensors for detecting whether the toner exists virtually in the toner containers are also outputted to the controller 74. As described below, in response to a detection signal with regard to one of the developing devices, the controller 74 controls the corresponding replenishment device so that controlled amount(s) of the toner(s) are replenished from the container(s) to the reservoir.

The printer 2 has a first print mode (also referred to herein as character mode) in which a binary image (also referred to herein as character image) such as character or drawing consisting of binary pixels is outputted and a second print mode (also referred to herein as photograph mode) in which a grayscale image (also referred to herein as photographic image) such as photograph consisting of multi-value pixels is outputted. In the embodiment, as described below, the controller 74 does not prohibit a printing operation in one of or both the print modes even if one of the two containers in the replenishment devices 64C or 64M is completely empty. The print mode can be selected by a user (i.e., a user command outputted to the printer 2 includes a selected print mode) or automatically be set based on image data outputted to the printer 2.

Referring now to FIGS. 6 and 7–10, a replenishment sequence of the cyan developer will be described. This sequence is performed, for example, when the printer 2 is activated and/or every time when the developing device 10C has operated for a predetermined period of time. First, at step 1, the controller 74 makes a determination as to whether a detection signal is outputted from the empty sensor 62C. If the determination is negative, i.e., a sufficient amount of the cyan developer remains in the reservoir 14C, the process moves to step 2, where the controller 74 makes a determination based on a signal from the magnetic permeability detection sensor 60C as to whether the detection voltage is equal to or more than $v_L$ (i.e., whether the mixture ratio is equal to or more than $R_L$). As such, the controller 74 serves as a unit to determine a mixture ratio of the two types of toner based on a magnetic permeability of the mixed developer in the reservoir 14C detected by the magnetic permeability sensor 60C. If the determination is affirmative, the process moves to step 3. At step 3, no replenishment is performed. The developing device 10C is ready to supply the cyan developer to the photoreceptor drum 4 regardless of the kind of the print mode (character mode or photograph mode) when the printer 2 receives a print command as well as image data (which is to be stored in the image memory). Whether a printing operation is actually carried out depends on a state of the other developing devices 10M, 10Y and 10K. For example, where all the developing devices 10C–10K are ready to supply their respective developers regardless of the kind of the print mode, the printer 2 performs a printing operation.

If the determination is negative at step 2 (i.e., there is no sufficient amount of the LRD cyan toner in the reservoir 14C), the controller 74 makes a determination at step 4 as to whether it receives a detection signal from the empty sensor 76L. Where the controller 74 receives the detection signal, i.e., where there is substantially no LRD cyan toner $T_L$ remaining in the container 66L, the LRD toner can not be replenished. On the other hand, since the percentage of the amount of the HRD toner is higher than a predetermined value in the reservoir 14C, a character image can be printed although a grayscale photographic image can not be reproduced. Thus, at step 5, when the printer 2 receives a print command and image data, the developing device 10C is not ready in the photograph mode but ready in the character mode to supply a cyan developer to the photoreceptor drum 4. Whether a printing operation is actually carried out depends on a state of the other developing devices 10M, 10Y and 10K. For example, where the other developing devices 10M, 10Y and 10K are also ready to supply their respective developers at least in the character mode, the printer 2 performs a printing operation in the character mode. As such, the controller 74 serves to allow or prohibit a printing operation according to the selected print mode based on the detection result acquired by a detector for detecting whether each toner container 66L or 66H is completely empty of toner or not. Since a printing operation is allowed in the character mode even if the container 66L of the LRD toner is completely empty of toner, a dead time can be reduced.

At step 4, if the determination is negative, i.e., the LRD cyan toner $T_L$ is virtually left in the container 66L, the process moves to step 6. The LRD cyan toner $T_L$ is replenished from the container 66L to the reservoir 14C so that the detection voltage is equal to or more than $v_L$ (the mixture ratio is equal to or more than $R_L$) unless the container 66L is completely empty of toner (See steps 2 and 4).

If the determination is affirmative at step 1, i.e., a sufficient amount of the cyan developer does not remain in the reservoir 14C, the controller 74 makes a determination at step 7 based on a signal from the magnetic permeability detection sensor 60C as to whether the detection voltage is equal to or more than $v_L$ (whether the mixture ratio is equal to or more than $R_L$). If the determination is affirmative, a determination is made at step 8 as to whether a detection signal is outputted from the empty sensor 76L. If the determination is affirmative, i.e., there is substantially no LRD cyan toner $T_L$ in the container 66L, a determination is made at step 9 as to whether a detection signal is outputted from the empty sensor 76H. If the determination is affirmative, i.e., there is substantially no HRD cyan toner $T_H$ in the container 66H, the developing device is not ready to supply a cyan developer to the photoreceptor drum 4 (step 10). Accordingly, even if the printer 2 receives a print command and image data, a printing operation is not performed regardless of the kind of the print mode. In this case, a user needs to exchange both the containers 66L and 66H with new ones.

If the determination is negative at step 9, i.e., the HRD cyan toner $T_H$ is virtually left in the container 66H, a predetermined amount of the HRD cyan toner $T_H$ is replenished from the container 66H to the reservoir 14C at step 11. Instead, the HRD cyan toner $T_H$ may be replenished until the container 66H becomes completely empty even if an amount of the replenished toner does not reach the predetermined amount. In this case, although there may be a case where a mixture ratio of the mixed cyan developer in the reservoir 14C falls out of the predetermined range (the ratio is less than the lower limit $R_L$), a character image can be printed while a photographic image can not be reproduced. Accordingly, at step 12, when the printer 2 receives a print command and image data, the developing device 10C is not ready in the photograph mode but is ready in the character mode to supply a cyan developer to the photoreceptor drum 4. As such, even if the container 66L of the LRD toner is completely empty, a printing operation can be performed in the character mode without exchanging it with a new one. This allows a dead time to be reduced. If the determination is negative at step 8, i.e., the LRD cyan toner $T_L$ is virtually left in the container 66L, a determination is made at step 13 as to whether a detection signal is outputted from the empty sensor 76H. If the determination is affirmative, i.e., there is substantially no HRD cyan toner $T_H$ in the container 66H, a process moves to step 14, where a predetermined amount of the LRD toner $T_L$ is replenished from the container 66L to the reservoir 14C (the mixture ratio remains equal to or more than $R_L$) Instead, the LRD cyan toner $T_L$ may be replenished until the container 66L is completely empty even if an amount of the replenished toner does not reach the predetermined amount. Although there is a small amount of the HRD cyan toner $T_H$ in the reservoir 14C, the LRD cyan toner $T_L$ can be used to reproduce both photographic and character images. Accordingly, at step 15, when the printer 2 receives a print command and image data, the developing device 10C is ready to supply a cyan developer to the photoreceptor drum 4 regardless of the kind of the print mode.

If the determination is negative at step 13, i.e., the HRD cyan toner $T_H$ is virtually left in the container 66H, a process moves to step 16, where predetermined amounts of the LRD toner $T_L$ and the HRD toner $T_H$ are replenished from the containers 66H and 66L to the reservoir 14C so that the mixture ratio remains equal to or more than $R_L$. Thereafter, the process moves to step 15.

If the determination is negative at step 7, i.e., the percentage of the amount of the LRD cyan toner in the reservoir 14C is small, a determination is made at step 17 as to whether a detection signal is outputted from the empty sensor 76L. If the determination is affirmative, i.e., there is substantially no LRD cyan toner $T_L$ in the container 66L, the process moves to step 18. Steps 18–21 are identical to steps 9–12. That is, if there is substantially no HRD cyan toner $T_H$ in the container 66H (YES at step 18), the developing device 10C is not ready to supply a cyan developer to the photoreceptor drum 4 (step 19). Accordingly, even if the printer 2 receives a print command and image data, it does not perform a printing operation regardless of the kind of the print mode. If the HRD cyan toner $T_H$ is virtually left in the container 66H (NO at step 18), a predetermined amount of the HRD cyan toner $T_H$ is replenished from the container 66H to the reservoir 14C or all of the HRD cyan toner is replenished until the container 66H is completely empty of toner (step 20). In this state, when the printer 2 receives a print command and image data, the developing device 10C is not ready in the photograph mode but is ready in the character mode to supply a cyan developer to the photoreceptor drum 4 (step 21). As such, even if the container 66L is completely empty of the LRD toner, a printing operation can be performed in the character mode without exchanging it with a new one. This allows a dead time to be reduced.

If the determination is negative at step 17, i.e., the LRD cyan toner $T_L$ is virtually left in the container 66L, a determination is made at step 22 as to whether a detection signal is outputted from the empty sensor 76H. If the determination is affirmative, i.e., there is substantially no HRD cyan toner $T_H$ in the container 66H, a process moves to step 23. Steps 23–27 are similar to steps 2–6. That is, if the LRD cyan toner $T_L$ is left in the container 66C, the LRD cyan toner $T_L$ is replenished from the container 66L to the reservoir 14C so that the mixture ratio is equal to or more than $R_L$ unless the container becomes completely empty (steps 23, 24 and 26). If the mixture ratio becomes equal to or more than $R_L$ (YES at step 24), since the developing device 10C has a certain amount of the LRD cyan toner in the reservoir 14C, it is ready to supply a cyan developer to the photoreceptor drum 4 regardless of the kind of the print mode (step 25). However, if the container 66L becomes completely empty before the mixture ratio reaches $R_L$ (YES at step 26), a process moves to step 27. Since there is no sufficient amount of the HRD cyan toner in the container 14C and the mixture ratio is under the lower limit, unlike at step 5, the developing device is not ready to supply a cyan developer to the photoreceptor drum 4. In this case, a user needs to exchange both the containers 66L and 66H with new ones.

If the determination is negative at step 22, i.e., the HRD cyan toner $T_H$ is virtually left in the container 66H, a process moves to step 28. At step 28, suitable amounts of the LRD toner $T_L$ and the HRD toner $T_H$ are replenished from the containers 66L and 66H to the reservoir 14C, aiming at a mixture ratio equal to or more than $R_L$. If the mixture ratio is equal to or more than $R_L$ at step 29, a process moves to step 30. Since the developing device 10C has a certain amount of the mixed cyan developer in the reservoir 14C, it is ready to supply the cyan developer to the photoreceptor drum 4 regardless of the kind of the print mode. If the mixture ratio is less than $R_L$ at step 29, a determination is made at step 31 as to whether at least one of the containers 66L and 66H is completely empty. If the determination is negative, a process returns to step 28, where replenishment of the toner(s) continues. If the determination is affirmative at step 31, a process moves to step 32. Since there is no sufficient amount of the HRD cyan toner and the mixture ratio is under the lower limit, the developing device 10C is not ready to supply a cyan developer to the photoreceptor drum 4. In this case, a user needs to exchange a toner-empty container with a new one.

As described above, the replenishment sequence is carried out when the printer 2 is activated and/or each time when the developing device 10C has operated for a predetermined period of time. In addition, it may be automatically started when the controller 74 receives a signal from the empty sensor 62C, indicating that the reservoir of the developing device 10C is nearly empty of developer. In this case, the steps 7 to 32 are performed.

A replenishment sequence of the magenta developer is identical to that of a cyan developer.

A replenishment sequence of the yellow and black developers is a conventional one. That is, the controller 74, when receiving a detection signal from the empty sensor 62Y or 62K, controls the replenishment device 64Y or 64K to replenish the corresponding developer from the container to the reservoir 14Y or 14M. If the toner container of the replenishment device 64Y or 64K becomes completely empty, it needs to be exchanged with a new one.

Although in the embodiment a developer including two types of toner having a generally identical hue and different reflection densities, the number of types of toner may be three or more. In this case, a replenishment device with a plurality of containers each for accommodating one of a plurality of types of toner may be used. A mixture ratio of three or more types of toner is defined, for example, as a weight ratio of each type of toner relative to one type of toner. Also, although in the embodiment a single-component developer including two types of toner and no carrier is used, a "two-component" developer including a plurality of types of toner with different reflection densities and a carrier may be used.

Further, although in the embodiment detection is made as to whether the developer reservoir is nearly empty of developer, it may be as to whether it is completely empty of developer, i.e., whether there is no sufficient mixed developer to supply to the photoreceptor drum. In this case, with regard to each of the toner containers, (although a mixture ratio of the toners in the developer reservoir can not be determined when the reservoir becomes completely empty) a suitable amount of the toner is replenished from the toner container in which the toner is virtually left. However, the construction of the present embodiment is preferable in which detection is made as to whether the developer reservoir is nearly empty in that image quality is ensured.

Furthermore, although in the embodiment two types of toner are accommodated, respectively, in the two toner containers, the HRD toner may be accommodated in one of the two containers and a toner mixture of the HRD toner and the LRD toner in the other. In this case, if the developer reservoir is nearly (or completely) empty of developer, the toner container of the toner mixture is completely empty of toner, the toner container of the HRD toner is not completely empty of toner, the controller controls the replenishment device so that the HRD toner is replenished to the mixed developer reservoir and allows a printing operation in the character mode but prohibits a printing operation in the photograph mode. On the other hand, if the developer reservoir is nearly (or completely) empty of developer, the toner container of the HRD toner is completely empty of toner, the toner container of the toner mixture is not completely empty of toner, the controller controls the replenishment device so that the LRD and the HRD toners are replenished to the mixed developer reservoir and allows a printing operation both in the character and the photograph modes.

In addition, a sensor may be provided such as optical sensor in order to prevent an excessive amount of toner to be supplied from the replenishment device to the mixed developer reservoir.

Second Embodiment

In the first embodiment, only a lower limit of the mixture ratio of the mixed developer is taken into consideration. This means that a mixture ratio may decrease but never rises as the number of documents that have been printed is increased. More specifically, where images having many shadow areas such as character image are successively printed, consumption of the HRD toner is large. However, since the HRD and the LRD toners continue to be consumed in a ratio (weight ratio) generally identical to the mixture ratio in the developer reservoir, the mixture ratio never rises. However, where a too large amount of the LRD toner is replenished from the replenishment device to the developing device, a large amount of the LRD toner is consumed where an image with many shadow areas is formed. Thus, to suppress consumption of the LRD toner, an upper limit $R_H$ of the mixture ratio needs to be set so that controlled amount(s) of the toner(s) are replenished from the replenishment device in order that the mixture ratio of the mixed developer never exceeds the upper limit.

Figure 11:
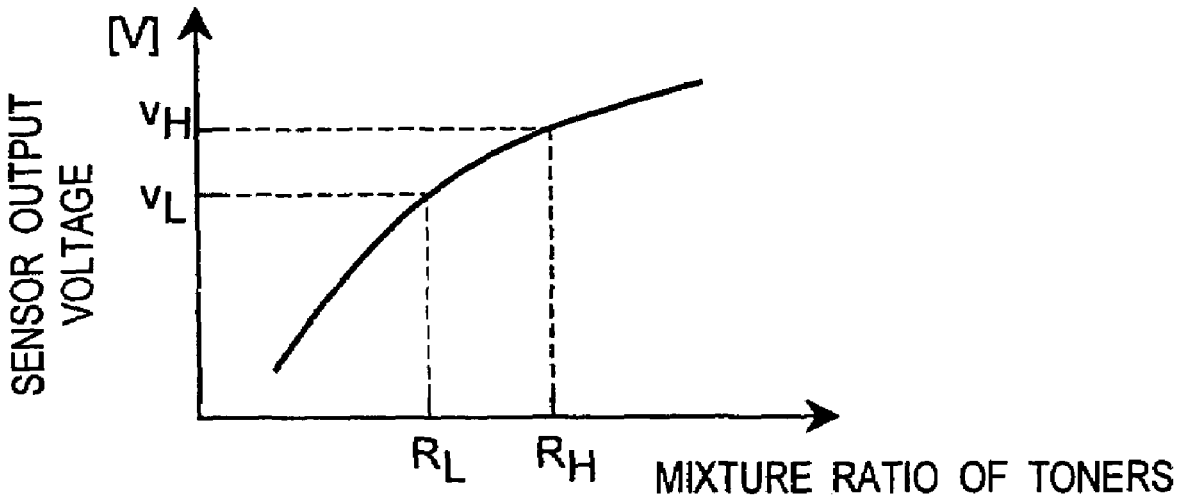
FIG. 11 is a graph showing a relationship between a mixture ratio of the two types of toner and a voltage outputted from the magnetic permeability detection sensor in a second embodiment of the image forming device according to the present invention.

In the embodiment, as shown in FIG. 11, which is similar to FIG. 5, the sensors 60C and 60M are designed so that they generate a higher detection voltage as the magnetic permeability is lower (the percentage of the non-magnetic LRD is higher). A voltage outputted from the sensor 60C or 60M that is not less than $v_L$ and not more than $v_H$ corresponds to a mixture ratio not less than $R_L$ and not more than $R_H$.

Figure 12:
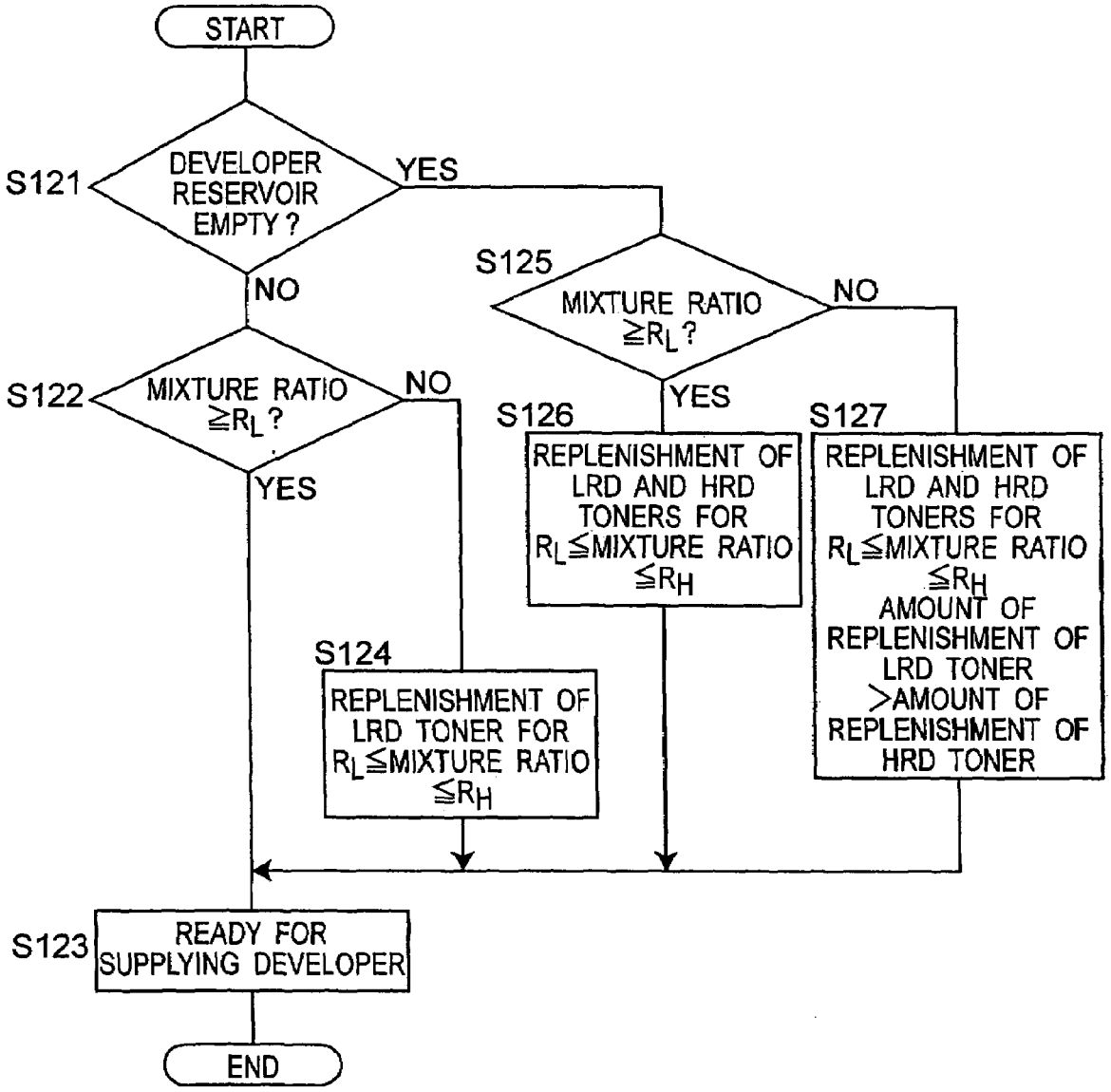
FIG. 12 is a flowchart illustrating a replenishment sequence of the cyan developer in the second embodiment.

Referring to FIGS. 6 and 12, a replenishment sequence of the cyan developer will be described. In the following description, it is assumed that sufficient amounts of the LRD and the HRD toners are left in the containers 66L and 66H and therefore the containers never become completely empty of toner during the sequence (accordingly, a printing operation is performed regardless of the kind of the print mode).

This sequence is performed, for example, when the printer 2 is activated and/or every time when the developing device 10C has operated for a predetermined period of time. First, at step 121, the controller 74 makes a determination as to whether a detection signal is outputted from the empty sensor 62C. If the determination is negative, i.e., a sufficient amount of the cyan developer remains in the reservoir 14C, the process moves to step 122, where the controller 74 makes a determination based on a signal from the magnetic permeability detection sensor 60C as to whether the detection voltage is equal to or more than $v_L$ (i.e., whether the mixture ratio is equal to or more than $R_L$). If the determination is affirmative, the process moves to step 123. At step 123, no replenishment is performed and the developing device 10C is ready to supply a cyan developer to the photoreceptor drum 4. Thereafter, the process is done.

If the determination is negative at step 122 (i.e., there is no sufficient amount of the LRD cyan toner in the reservoir 14C), the process moves to 4, where the LRD cyan toner is replenished from the container 66L to the reservoir 14C so that the detection voltage is not less than $v_L$ and not more than $v_H$ (the mixture ratio is not less than $R_L$ and not more than $R_H$). Thereafter, the process moves to step 123.

If the determination is affirmative at step 121, i.e., a sufficient amount of the cyan developer does not remain in the reservoir 14C, the controller 74 makes a determination at step 125 based on a signal from the magnetic permeability detection sensor 60C as to whether the detection voltage is equal to or more than $v_L$. If the determination is affirmative, the process moves to step 126. At step 126, suitable amounts of the HRD and the LRD toners are replenished from the containers 66H and 66L to the reservoir 14C so that the detection voltage remains equal to or more than $v_L$ (the mixture ratio remains equal to or more than $R_L$) and does not exceed $v_H$ (the mixture ratio does not exceed $R_H$). Thereafter, the process moves to step 123.

If the determination is negative at step 125, i.e., the percentage of the amount of the LRD cyan toner in the reservoir 14C is small, the process moves to step 127, where both the LRD cyan toner and the HRD cyan toner are replenished from the containers 66L and 66H to the reservoir 14C so that the detection voltage is not less than $v_L$ and not more than $v_H$ (the mixture ratio is not less than $R_L$ and not more than $R_H$). The amount of the LRD cyan toner to be replenished is larger than that of the HRD cyan toner. Only the LRD cyan toner may be replenished to the reservoir 14C although only a small amount of the HRD cyan toner remains in the reservoir. Thereafter, the process moves to step 123.

As such, since the LRD and the HRD toners are separately accommodated in the containers 66L and 66H, toner replenishment can easily be controlled to allow the mixture ratio to fall within a predetermined range (See steps 124, 126 and 127).

Also, in the embodiment, a mixture ratio of the mixed developer in the reservoir 14C is determined and detection is made as to whether the reservoir 14C is nearly empty of developer. The replenishment of toner is controlled based on the determined mixture ratio and the detection result so that the mixture ratio falls within a predetermined range. This results in stable and high image quality after a number of documents have been printed.

As described above, the replenishment sequence is carried out when the printer 2 is activated and/or each time when the developing device 10C has operated for a predetermined period of time. In addition, it may be automatically started when the controller 74 receives a signal from the empty sensor 62C, indicating that the reservoir of the developing device 10C is nearly empty of developer. In this case, the steps 3 and 5 to 7 are performed.

Although in the embodiment a developer including two types of toner having a generally identical hue and different reflection densities, the number of types of toner may be three or more, as in the previous embodiment. In this case, a replenishment device with a plurality of containers each for accommodating one of a plurality of types of toner may be used. Also, although in the embodiment a single-component developer including two types of toner and no carrier is used, a "two-component" developer including a plurality of types of toner with different reflection densities and a carrier may be used.

Further, although in the embodiment two types of toner are accommodated, respectively, in the two toner containers, two toner mixtures including two types of toner that are mixed with different mixture ratios may be accommodated, respectively, in the two toner containers. For example, one toner mixture in which the weight of the LRD toner is greater than that of the HRD toner is accommodated in one of the two containers while the other toner mixture in which the weight of the LRD toner is smaller than that of the HRD toner is accommodated in the other (in other words, mixture ratios are different between the two toner containers). The mixing of the two types of toner in advance and the accommodation thereof in the toner containers suppresses non-uniform mixing in the developer reservoir, which would otherwise be generated in the replenishment operation of the toner(s). This holds true for a construction in which three or more toner containers are used, which is included within the scope of the invention.

In addition, the HRD toner may be accommodated in one of the two containers and a toner mixture of the HRD toner and the LRD toner in the other. Likewise, the LRD toner may be accommodated in one of the two containers and a toner mixture of the HRD toner and the LRD toner in the other. In other words, only one type of toner is accommodated in one of the toner containers and two types of toner including the one type of toner are accommodated in the other. The former arrangement is suitable where a user of the image forming device often prints a binary image such as character or drawing and therefore a larger amount of the HRD toner is consumed. The latter arrangement is suitable where a user prints a grayscale image such as photograph and therefore a larger amount of the LRD toner is consumed. The arrangement may be selected, for example, by a serviceman in charge of the maintenance of the image forming device based on image data inputted into the device.

A construction is also included within the scope of the invention in which three or more toner containers are provided, at least one of which accommodates two or more types of toner out of a plurality of types of toner and one another of which accommodates one type of toner out of the plurality of types of toner (in other words, a toner container for accommodating only one type of toner and a toner container for accommodating two or more types of toner including or not including the one type of toner).

In the embodiment, the controller 74 serves to determine a mixture ratio of the toners in the developer reservoir and control the replenishment device 64C based on the determined mixture ratio and a detection signal from the empty sensor 62C (which detects whether the developer reservoir of the developing device 10C is nearly empty of mixed developer) so that the mixture ratio falls within a predetermined range. Instead, a controller (other than the controller 74) for determining a mixture ratio and controlling the replenishment device may be incorporated in a developing unit. The developing unit may be designed to include the developing device and the replenishment device and be removably attached to the image forming apparatus.

Figure 13A:
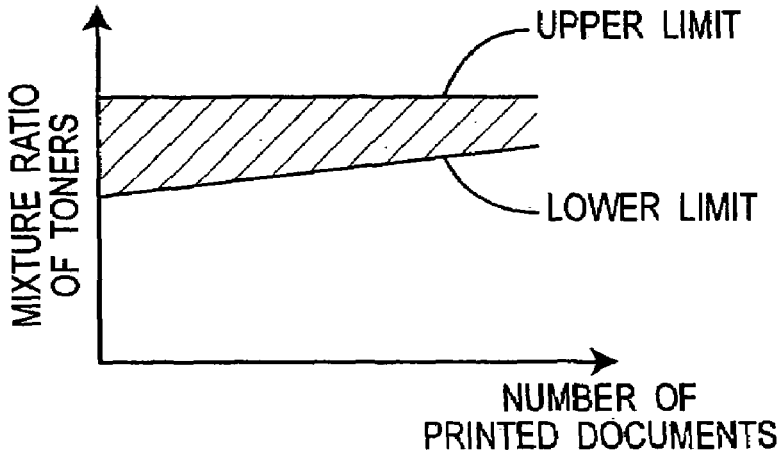
FIGS. 13A and 13B are graphs each showing an example of a desired range of the mixture ratio that varies depending on the number of documents that have been printed.
Figure 13B:
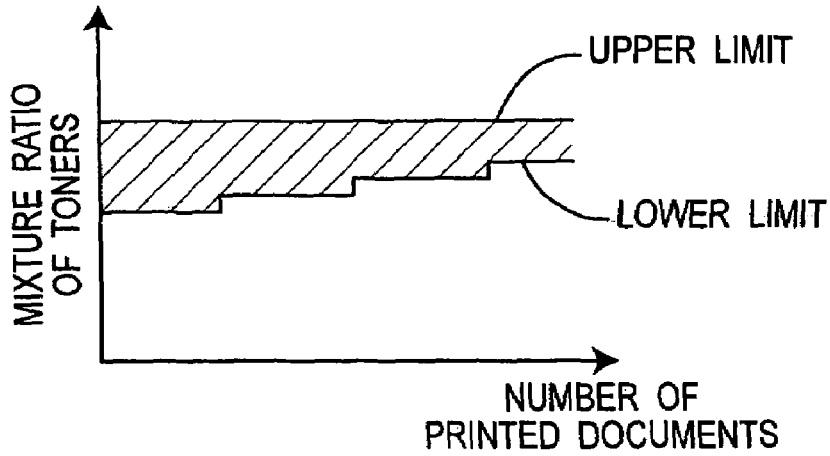

In general, as the number of documents that have been printed is increased, charging and transfer characteristics are less uniform. The charging characteristic is less uniform due to, for example, non-uniformity of the thickness of the photoreceptor drum (because of deterioration of the photoreceptor drum, i.e., abrasion of the drum surface) or contamination of the charging device. The transfer characteristic is less uniform due to, for example, scratches on the intermediate transfer belt. This results in deterioration of image quality. To deal with this problem, the lower limit of the mixture ratio is set to be higher in a continuous manner as in FIG. 13A or in a step-by-step manner as in FIG. 13B as the number of documents that have been printed is increased. Accordingly, as the number of documents that have been printed is increased, replenishment of toner is performed so that the percentage of the LRD toner in the mixed developer is increased, thereby suppressing deterioration of image quality. To this end, a counter for counting the number of documents that have been printed or a sensor for detecting a surface electric potential of the photoreceptor drum as well as a memory for storing data corresponding to FIG. 13A or 13B are provided in the printer 2. The controller 74 controls the replenishment device based on the counter value and the detection result.

In the embodiment, the mixture ratio is defined so that it is increased as the percentage of the LRD toner in the mixed developer in the developer reservoir is increased. Where the mixture ratio is defined, instead, so that it is decreased as the percentage of the LRD toner in the mixed developer in the developer reservoir is increased, the upper limit of the mixture ratio is set to be lower as the number of documents that have been printed is increased.

There has been described in detail for preferred embodiments of the image forming apparatus according to the present invention, but it is to be understood that various modifications can be effected within the spirit and scope of the invention. For example, although in the previous embodiments only the cyan and magenta developers are a mixed developer having two or more types of toner with different reflection densities, the yellow and/or black developers may be a mixed developer.

Also, the present invention is not limited to a color image forming apparatus and may be applied to a monochrome image forming apparatus (not limitative of an apparatus for black). Further, the present invention can be applied to an image forming apparatus other than a printer.

What is claimed is:

1. An electrophotographic image forming apparatus, comprising:

a developing device including a developer reservoir for accommodating a mixed developer including a plurality of types of toner having a generally identical hue and different reflection densities;

a replenishment device including a plurality of toner containers each accommodating one of the plurality of types of toner for replenishing the plurality of types of toner to the developer reservoir;

a first detector for detecting whether each of the toner containers is completely empty of toner;

a second detector for detecting whether the developer reservoir is nearly or completely empty of mixed developer; and a controller for controlling the replenishment device and allows or prohibits a printing operation based on the detection result of the first and the second detectors.

2. The image forming apparatus in accordance with claim 1, including a first print mode in which a binary image is formed and a second print mode in which a grayscale image is formed, wherein the replenishment device includes a first toner container for accommodating toner with a low reflection density and a second toner container for accommodating toner with a high reflection density toner, and if the second detector detects the developer reservoir being nearly or completely empty of mixed developer and the first detector detects the second toner container being completely empty of toner and the first toner container not being completely empty of toner, the controller controls the replenishment device so that the toner with a low reflection density is replenished from the first toner container to the developer reservoir and allows a printing operation in the first and the second print modes.

3. The image forming apparatus in accordance with claim 1, including a first print mode in which a binary image is formed and a second print mode in which a grayscale image is formed, wherein the replenishment device includes a first toner container for accommodating toner with a low reflection density and a second toner container for accommodating toner with a high reflection density, and if the second detector detects the developer reservoir being nearly or completely empty of mixed developer and the first detector detects the first toner container being completely empty of toner and the second toner container not being completely empty of toner, the controller controls the replenishment device so that the toner with a high reflection density is replenished from the second toner container to the developer reservoir, allows a printing operation in the first print mode and prohibits a printing operation in the second print mode.

4. An electrophotographic image forming apparatus, including a first print mode in which a binary image is formed and a second print mode in which a grayscale image is formed, the apparatus comprising:

a developing device including a developer reservoir for accommodating a mixed developer including two types of toner having a generally identical hue and different reflection densities;

a replenishment device including a first toner container for accommodating toner with a high reflection density and a second toner container for accommodating said toner and a low reflection density toner for replenishing the toners to the developer reservoir;

a first detector for detecting whether each of the toner containers is completely empty of toner;

a second detector for detecting whether the developer reservoir is nearly or completely empty of mixed developer; and a controller for controlling the replenishment device based on the detection result of the first and the second detectors and allows or prohibits a printing operation based on the printing mode.

5. The image forming apparatus in accordance with claim 4, wherein, if the second detector detects the developer reservoir being nearly or completely empty of mixed developer and the first detector detects the second toner container being completely empty of toner and the first toner container not being completely empty of toner, the controller controls the replenishment device so that the toner with a high reflection density is replenished from the first toner container to the developer reservoir, allows a printing operation in the first print mode and prohibits a printing operation in the second print mode.

6. An electrophotographic image forming apparatus, comprising:

a developing device including a developer reservoir for accommodating a mixed developer including two types of toner having a generally identical hue and different reflection densities;

a replenishment device for replenishing the two types of toner to the developer reservoir;

a unit for determining a mixture ratio of the two types of toner in the developer reservoir;

a detector for detecting whether the developer reservoir is nearly empty of mixed developer; and a controller for controlling the replenishment device based on the mixture ratio determined by the unit and the detection result acquired by the detector so that the mixture ratio falls within a predetermined range.

7. The image forming apparatus in accordance with claim 6, wherein the range is defined as not less than a first threshold and not more than a second threshold, the mixture ratio is defined so that it is increased as the percentage of toner with a low reflection density in the mixed developer in the developer reservoir is increased, and the first threshold is set to be higher as the number of document that have been printed.

8. The image forming apparatus in accordance with claim 6, wherein the range is defined as not less than a first threshold and not more than a second threshold, the mixture ratio is defined so that it is decreased as the percentage of toner with a low reflection density in the mixed developer in the developer reservoir is increased, and the second threshold is set to be lower as the number of document that have been printed.

9. A developing unit, comprising:

a developing device including a developer reservoir for accommodating a mixed developer including two types of toner having a generally identical hue and different reflection densities;

a replenishment device for replenishing the two types of toner to the developer reservoir;

a unit for determining a mixture ratio of the two types of toner in the developer reservoir;

a detector for detecting whether the developer reservoir is nearly empty of mixed developer; and a controller for controlling the replenishment device based on the mixture ratio determined by the unit and the detection result acquired by the detector so that the mixture ratio falls within a predetermined range.

10. An electrophotographic image forming apparatus, comprising:

a developing device including a developer reservoir to accommodate a mixed developer including a plurality of types of toner having a generally identical hue and different reflection densities; and a replenishment device to replenish said plurality of types of toner to the developer reservoir, the replenishment device including a first toner container to accommodate at least one type of toner out of said plurality of types of toner, and a second toner container to accommodate at least one other type of toner out of said plurality of types of toner, wherein the first toner container accommodates a first toner mixture including said plurality of types of toner mixed with a first mixture ratio and the second toner container accommodates a second toner mixture including said plurality of types of toner mixed with a second mixture ratio.

11. An electrophotographic image forming apparatus, comprising:

a developing device including a developer reservoir to accommodate a mixed developer including a plurality of types of toner having a generally identical hue and different reflection densities; and a replenishment device to replenish said plurality of types of toner to the developer reservoir, the replenishment device including a first toner container to accommodate at least one type of toner out of said plurality of types of toner, and a second toner container to accommodate at least one other type of toner out of said plurality of types of toner, wherein the first toner container accommodates only one type of toner out of said plurality of types of toner and the second toner container accommodates a toner mixture including mixed two or more types of toner out of said plurality of types of toner.

* * * * *